US006279902B1

(12) United States Patent
Yamazaki et al.

(10) Patent No.: US 6,279,902 B1
(45) **Date of Patent: *Aug. 28, 2001**

(54) GAME SYSTEM

(75) Inventors: Shunpei Yamazaki, Tokyo; Akiharu Miyanaga; Toshiji Hamatani, both of Kanagawa, all of (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/432,108

(22) Filed: Nov. 2, 1999

Related U.S. Application Data

(62) Division of application No. 09/079,155, filed on May 15, 1998, now Pat. No. 6,000,696, which is a division of application No. 08/722,949, filed on Sep. 27, 1996, now Pat. No. 5,769,415, which is a division of application No. 08/354,423, filed on Dec. 12, 1994, now Pat. No. 5,560,601, which is a division of application No. 08/139,733, filed on Oct. 22, 1993, now Pat. No. 5,395,110.

(30) Foreign Application Priority Data

Oct. 22, 1992 (JP) ..... 4-308327

(51) Int. Cl.[7] ..... A63F 7/00

(52) U.S. Cl. ..... 273/108; 273/118 R; 273/118 A; 273/121 B; 273/138 R

(58) Field of Search ..... 273/108, 118–125, 273/142, 143; 463/16, 36

(56) References Cited

U.S. PATENT DOCUMENTS

| | | | |
|---|---|---|---|
| 4,149,716 | 4/1979 | Scudder . | |
| 4,964,638 | 10/1990 | Ishida . | |
| 5,004,238 | 4/1991 | Okada . | |
| 5,007,087 | 4/1991 | Bernstein et al. . | |
| 5,016,879 | 5/1991 | Parker et al. . | |
| 5,048,086 | 9/1991 | Bianco et al. . | |
| 5,060,947 | 10/1991 | Hall . | |
| 5,136,686 | 8/1992 | Koza . | |
| 5,151,900 | 9/1992 | Snyder et al. . | |
| 5,201,321 | 4/1993 | Fulton . | |
| 5,270,748 | 12/1993 | Katz . | |
| 5,318,295 | 6/1994 | Höfer . | |
| 5,360,971 | 11/1994 | Kaufman et al. . | |
| 5,362,049 | 11/1994 | Höfer . | |
| 5,395,110 | 3/1995 | Yamazaki et al. . | |
| 5,560,601 | * 10/1996 | Yamazaki et al. | 273/108 |
| 5,769,415 | 6/1998 | Yamazaki et al. . | |
| 5,800,265 | 9/1998 | Yamazaki et al. . | |
| 6,000,696 | * 12/1999 | Yamazaki et al. | 273/108 |

FOREIGN PATENT DOCUMENTS

| | | |
|---|---|---|
| 59-186580 | 10/1984 | (JP) . |
| 1-244782 | 9/1989 | (JP) . |
| 2-098386 | 4/1990 | (JP) . |
| 2-297392 | 12/1990 | (JP) . |
| 3-029681 | 2/1991 | (JP) . |
| 3-075078 | 3/1991 | (JP) . |
| 3-286789 | 12/1991 | (JP) . |
| 4-071580 | 3/1992 | (JP) . |
| 4-075674 | 3/1992 | (JP) . |
| 4-208136 | 7/1992 | (JP) . |
| 4-325180 | 11/1992 | (JP) . |
| 4-335730 | 11/1992 | (JP) . |
| 5-003951 | 1/1993 | (JP) . |
| 86-01317 | 2/1986 | (WO) . |

* cited by examiner

*Primary Examiner*—Raleigh W. Chiu
(74) *Attorney, Agent, or Firm*—Eric J. Robinson; Nixon Peabody LLP

(57) ABSTRACT

A game machine enabled to make various responses by adding the psychosomatic state and emotion of the player as one of conditions for determining the responding manner. The psychosomatic state of the player is grasped to change the responses in accordance with the psychological state of the player by making use of both a chaos attractor obtained by numerically processing the information sampled from the player and the index indicating the degree how the chaos attractor matches the defining condition of the chaos.

27 Claims, 3 Drawing Sheets

GAME SYSTEM

This application is a Divisional of application Ser. No. 09/079,155 filed May 15, 1998; now U.S. Pat. No. 6,000,696; which itself is a Division of Ser. No. 08/722,949, filed Sep. 27, 1996; now U.S. Pat. No. 5,769,415; which is a Division of Ser. No. 08/354,423, filed Dec. 12, 1994, now U.S. Pat. No. 5,560,601; which is a Division of Ser. No. 08/139,733, filed Oct. 22, 1993, now U.S. Pat. No. 5,395,110.

BACKGROUND OF THE INVENTION

1. Field of the Invention

The present invention relates to a novel game machine responding to the psychosomatic state of a player and, more particularly, to a 'pachinko' machine using pachinko balls or a rotary drum type game machine having a rotary drum type graphic pattern combining unit, as will be called the slot machine or "pachislo".

2. Description of the Relevant Art

Generally speaking the pachinko machine using the pachinko balls are widely spread, and pachinko parlors are conducting business as one of the most popular amusements all over Japan.

In the pachinko game, the player buys some pachinko balls and shoots them by a shooting grip of the machine. If one of the balls luckily lands in a rewarding catcher, the player is rewarded with more balls. The shooting grip of the pachinko machine in recent years can shoot the balls continuously in electromechanical manners, and all that is required of the player is to turn the shooting grip. This raises a tendency to make the pachinko game monotonous. Thus, in order to promote the interest of the player and to reward all the players impartially with the rewarding balls, there has been developed and actually used a pachinko machine which is equipped with a game machine incorporating a game factor.

This pachinko machine starts the game machine, if predetermined conditions are satisfied, to determine the responses to be taken by the pachinko game so that the player can enjoy more advantageous game conditions. The pachinko machine of this type attracts the popular favor because the players can be rewarded with more balls independently of their skills.

Thus, the recent pachinko machines are equipped with numerous CPU control units as the electronics technology progresses. Specifically, the game machine packaged in the pachinko machine is substantially operated by the electronics technology, and this operation is controlled by the CPU, i.e., the so-called "microprocessor" or computer. This computer is assigned a role to compute various pieces of information from the pachinko machine itself or its game machine and to command the pachinko machine a predetermined operation according to a predetermined procedure (or program). However, this means mere electronization of the machine side, and the player can only await the decision made by the computer.

Along with the pachinko machines, a rotary drum type game machine (as is generally called the 'slot machine' or 'pachislo') having a rotary drum type graphic pattern combining unit recently grows popular as an interesting amusement. The player of this drum type game machine inserts a coin into the slot and pushes a start button to turn the graphic patterns of the drum so that he or she may be rewarded with more coils in accordance with the combination of the patterns.

This game machine is also equipped with numerous computer control units resulting from the progress of the electronics technology. Specifically, the rotary drum type graphic pattern combining unit is also substantially operated by the technology, and this operation is controlled and determined by the computer or microprocessor. The role of this microprocessor is to process various pieces of information obtained from the game machine and the pattern combining unit and to command the game machine a predetermined command in accordance with a predetermined procedure (or program). This raises a monotonous play like the pachinko machine.

The electronized pachinko machine and drum type game machine described above are enriched to have more varieties in plays than those of the existing game machines. Despite of this richness, however, the player will also lose interest before long as in the prior art. This is because the responses of the machines will grow monotonous while following the predetermined procedure or program. On the other hand, the human players have their emotions, senses, health conditions and psychosomatic states changed time by time so that they will lose interest for the responses being unchanged at the machine side.

SUMMARY OF THE INVENTION

In order to solve the problems of the prior art, therefore, the present invention has an object to provide a game machine which is enabled to make various responses by adding the psychosomatic state and emotion of the player as one of conditions for determining the responding manner.

According to a first aspect of the present invention, there is provided a game machine wherein the psychosomatic state of a player is grasped to change the responses in accordance with the psychological state of the player by making use of both a chaos attractor obtained by numerically processing the information sampled from the player and the index indicating the degree how said chaos attractor matches the defining condition of the chaos.

According to a second aspect of the present invention, there is provided a game machine comprising: a psychosomatic state grasping system including a sensor for fetching data from a player, a chaos attractor generator for calculating a chaos attractor by numerically processing the data fetched by said sensor, and a Ljapunov index calculator for calculating an index indicating the degree how said chaos attractor matches the defining condition of chaos; and changing means for changing the responses of said game machine in accordance with the information indicating the psychosomatic state of the player calculated by said system.

According to a third aspect of the present invention, there is provided a game parlor comprising: a plurality of pachinko machines each comprising a psychosomatic state grasping system including a sensor for fetching data from a player, a chaos attractor generator for calculating a chaos attractor by numerically processing the data fetched by said sensor, and a Ljapunov index calculator for calculating an index indicating the degree how said chaos attractor matches the defining condition of chaos; and changing means for changing the circumstances of the players or pachinko machines such as the kind, volume or tone quality of music to be serviced, or the brightness or color tone of illuminations in accordance with the information concerning the psychosomatic states of the players and coming from the pachinko machines.

According to a fourth embodiment of the present invention, there is provided a game machine wherein the situation of a player is assigned to a plurality of predetermined levels by utilizing the information sampled from the player, so that the responses of said game machine may be changed according to one of the levels.

The game machine may comprise a rotary drum type graphic pattern combining unit.

As described above, according to the present invention, the psychosomatic state of a player is grasped by comparing the chaos attractor peculiar to the player and obtained by numerically processing the information from the player and the condition defining the chaos whose attractor data are already known and subjected to a predetermined classification, so that the responses to be taken by the pachinko machine may be changed according to the psychological state of the player, thereby to prevent the game from growing monotonous or the player from losing interest.

Moreover, a more comfortable and less tiring game parlor is provide by making a change to the playing circumstances or optimizing the circumstances in accordance with the present situation of the player.

In another game machine to be provided, the present situations of the player are assigned to a plurality of levels on the basis of the information, which is obtained from the player even if it could not satisfy the concept of chaos, so that the responses may be changed in accordance with the levels.

What the chaos is will be described at first. The natural world or an artificial world experiences many predictable phenomena. The position of the Halley's comet or an artificial satellite can be predicted and responded to. The deterministic predictability in which the cause-result relation is clear is one of the greatest powers of science. However, the weather forecast seems to be the motion of air following the rules of physics but will not always come true. Even the phenomenon having the unclear cause-result relation has been believed to have random elements but to be accurately predicted if complete parameters describing the system are clear, that is, if the information of the system can be sufficiently collected.

In short, the random phenomena are thought to come from shortage of information of a system having multiple degrees of freedom. It is, however, found out that there is some phenomenon which is deterministic but has a substance of being random, by the discovery that even a simple system having a small number (e.g., three or more) of degrees of freedom may exhibit a random behavior. Ever since, this random phenomenon has been called the "chaos".

Despite of this fact, however, the concept of chaos is not unified yet. Like the theory of evolution, the definition of the chaos covers a wide range, and its concept for some object seems to walk by itself. Hence, we will dare to summarize the concept in the following manner.

The chaos should mean an essentially random phenomenon because it is a system which has deterministic rules but experiences seriously complex behaviors non-linearly. It is also indicated that any phenomenon apparently having neither regularity nor predictability is backed by complex orders or rules.

On the other hand, the topology characterizing the behaviors of the chaos is called the "chaos attractor", i.e., a mathematical structure into which converge the behaviors of the system generating the chaos.

From these viewpoints, the pulse waves detected from human bodies are known to have the chaos behaviors. In the academic society or the like, it has been reported by the authority of this field that the apex pulse waves indicate the psychosomatic information of the chaos. He also has applies for a Japanese patent the medical diagnosis making use of the chaos (as disclosed in Japanese Patent Laid-Open No. 208136/1992).

Thus, the present invention is an applied apparatus which has made positive use of the correlation between the chaos attractor obtained by numerically processing the pulse waves and the heartbeat or bodily temperature sampled from the body and the Ljapunov number indicating the degree how the data match the defining conditions of the chaos. Any other information can be used if it has a correlation with the psychosomatic state of the player.

Therefore, the information of the player is obtained by generating the chaos attractor which is obtained by numerically processing the pulse waves, heartbeats and bodily temperature sampled by the player. Thus, the psychosomatic state of the player can be grasped from the Ljapunov number indicating the degree how the data match the defining conditions of the chaos. The means for sampling the apex pulse waves is exemplified by either a sensor combining an infrared-emitting diode and a photo-sensor or a semiconductor pressure sensor.

The relations between the psychosomatic state and the chaos attractor of the apex pulse waves are summarized, as follows:

(1) The chaos attractor of the apex pulse waves reflects the mental and psychological states sensitively to indicate a specific topology;

(2) The chaos attractor obtained from the pulse waves has a personally peculiar structure over a basic structure common to the human being and changes according to the mental and psychological state and a disease;

(3) Generally speaking, when the metal and psychological states become unstable or when a disease occurs, the overall structure of the attractor becomes simple, and small. Moreover, a mechanical and monotonous periodic structure appears in the rhythm to depart the chaos;

(4) In the healthy state, the overall structure is complex and dynamic, and the local structure also exhibits a complex structure such as rolled, twisted or screwed structures. And, the rhythm becomes aperiodic. In short, the healthy mode is chaotic and is fully occupied by the chaos; and (5) If the consciousness is concentrated, the chaos attractor is complicated to have the rolled or twisted local structure. On the other hand, if a stress higher than a threshold value is received to invite a fatigue, the structure is simplified to lose the local structure.

According to the concept described, above, the present state of the player is classified into several kinds, according to which the responses of the pachinko machine or the rotary drum type game machine can be made different to provide a more complicated game content. Moreover, since the player has its state changed time by time, the interest of the player can be induced more by changing the responses of the pachinko machine or the game machine accordingly.

The simplest and most preferable portion of the body for obtaining the psychosomatic information of the player to achieve the chaos attractor is the fingertip, palm or arm of the player in dependence upon the shape of the machine being practically used at present. The portion to be sensed should not be limited to the specified ones but may be exemplified in the present invention by any other portion such as the head, buttock or skin of the player.

Likewise, the sensor to be disposed in the game machine can be mounted in various positions such as the ball shooting grip, the ball feed chute or the frame of the machine or the seat of the player. In the sense of modifying the exiting machine, the most convenient and inexpensive portion is located the ball shooting grip or the frame of the machine. Thus, the information of the player can be easily obtained by mounting the aforementioned photo-coupler or semiconductor pressure sensor in that portion.

The information of the player thus obtained is arithmetically processed, and it is decided whether or not the processed information matches a predetermined level. The Ljapunov index is then calculated according to the matching degree. This numerical processing and the calculation of the Ljapunov index have to resort to the computer operation, but this processing method and the expression of the processed chaos attractor are not especially restricted in their calculating equations or processing procedures but can be arbitrarily expressed and processed.

On the other hand, the levels determined in advance for calculating the Ljapunov index can be set in many manners according to the classifications of the chaos attractor. If the levels are set to the "excited state" and the "unexcited state", the levels are at two steps. If the "concentrated consciousness" and the "distracted consciousness" are added, the levels are totally at four steps. Since the responses of the play are changed according to those four steps, the play can have its content enriched more.

The responses to be taken by the machine on the basis of the information obtained from the player can be conceived such wide ones in case of the pachinko machine, as: the responses concerning the rewarding balls, e.g., the adjusting of the opening of the great-hit catcher after the lucky great-hit condition is satisfied, the change of the great-hit condition, the interval of opening the great-hit catcher; the responses concerning the circumstances of the player, e.g., the kind of music serviced from the machine during the play, the change in the display on the play board face or the change in lighting on the board face; the change in the responses of the shooter, e.g., the change in the initial velocity of the shot balls, the interval of the continuous shooting, or the turning stroke of the shooting grip; or the change in the circumstance for installing the machines. The other various responses can be incorporated into the range of the present invention.

Thanks to the changes in the responses of the pachinko machine within the range of inviting no disadvantage of the probability of rewarding the player the balls, the player can enjoy the change in the play responding to the present psychosomatic state.

The description made above is directed to the application of the concept of the chaos to the single game machine, but the concept can naturally be applied to the entire game parlor provided with a plurality of such machines.

Specifically, the present psychosomatic state of the players using the pachinko machines or the rotary drum type game machines are collected as the information, so that the responses such as the kind, volume or tone quality of the music to be serviced to the game parlor or the brightness or color tone of illuminations of the parlor can be changed on the basis of the collected state either all over the parlor or partially according to the distribution of the players in a specific psychosomatic state.

Thus, the game parlor is featured by promoting the interests of the players in the game to allow the players to enjoy the game under more comfortable circumstances.

Moreover, the description made above is directed mainly to such information obtained from the player as can adopt the concept of chaos. Even if, however, this concept is not applied to the information from the player, the playing quests are assigned to predetermined levels so that the responses of the machines can be changed according to the levels to complicate the game and attract the interests of the players.

Specifically, a temperature sensor is used to measure the present bodily temperatures of the players, and these temperatures are assigned to the predetermined levels. Specifically, the four levels are determined in advance to have ranges of no higher than 36° C., higher than 36° C. but no higher than 36.5° C., higher than 36.5° C. but no higher than 37° C., and higher than 37.5° C., so that the responses to be taken by the machine are changed depending upon what of those four levels the playing person belongs to.

Not only the aforementioned bodily temperature but also the pulse rate, the respiration rate, the surface temperature of the face or the body weight can be employed as the information of the player no matter whether it might belongs to the concept of chaos.

BRIEF DESCRIPTION OF THE DRAWINGS

Other objects, features and advantages of the present invention will become apparent from the following description to be made in connection with the embodiments with reference to the accompanying drawings, in which.

DESCRIPTION OF THE PREFERRED EMBODIMENTS

Embodiment 1

Figure 1:
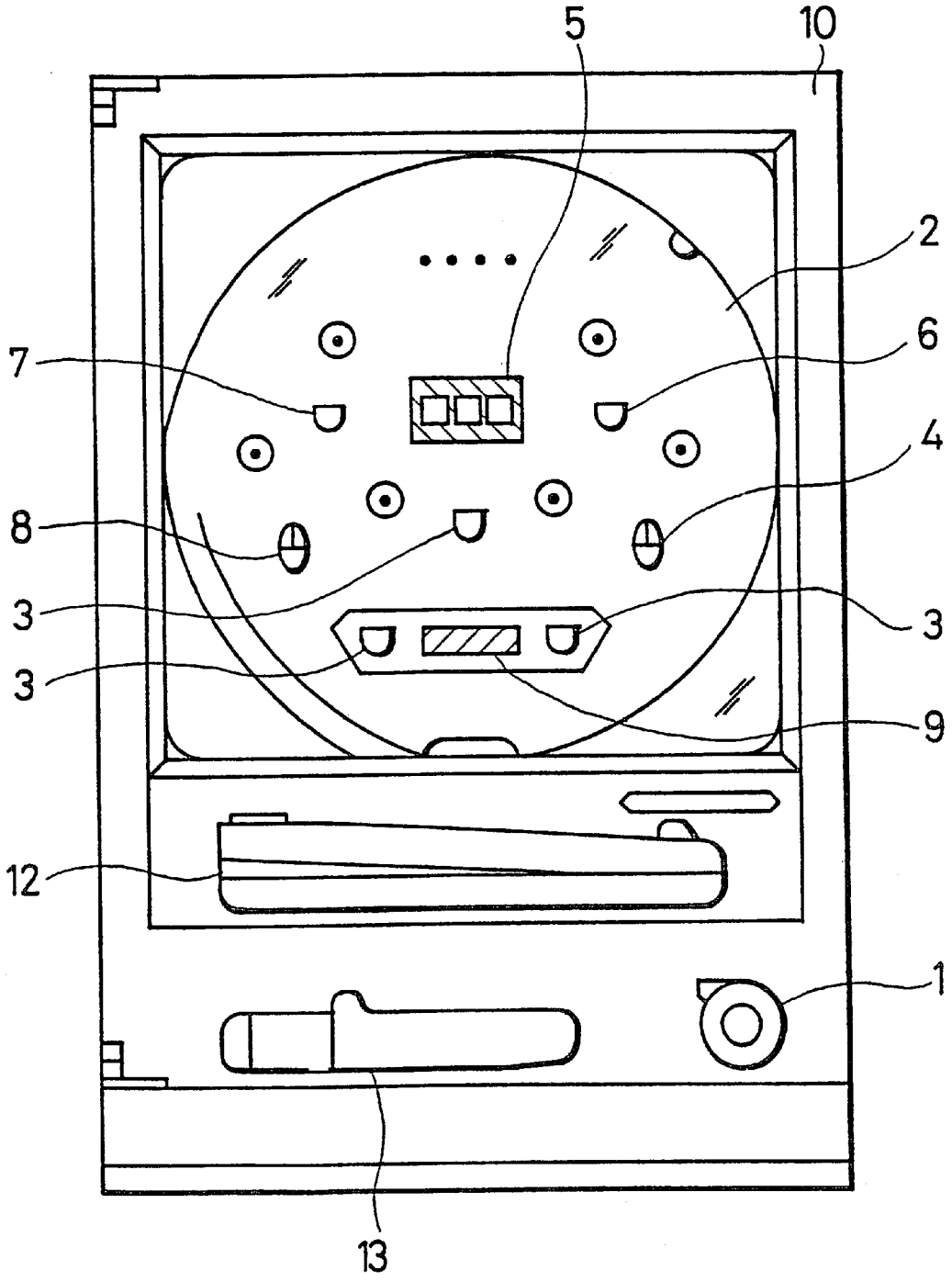
FIG. 1 is a schematic front elevation showing a pachinko machine according to the present invention.

The present embodiment will be described in case the concept of chaos of the present invention is applied to a 'pachinko' machine. FIG. 1 is a schematic diagram showing the pachinko machine of the present embodiment.

Reference numeral 1 designates a ball shooting grip, and numeral 2 designates a playing board face, which is equipped therein with rewarding catchers 4, 6, 7 and 8, a game indicator 5, rewarding catchers 3 having functions to start the game unit, and a great-hit catcher 9. The pachinko balls shot by the shooting machine are bounced in various directions to fly downward over the board face 2 by nails arranged in the board face 2.

When the pachinko ball lands in any of the rewarding catchers 3, 4, 6, 7 and 8, reward balls are supplied to a ball feed/reserve chute 12. Especially when a ball lands in the rewarding catcher 3, the game unit is started in addition to the supply of reward balls. This game unit changes indications of three figures in the game indicator 5 and interrupts the change after lapse of a predetermined time period. The game unit commands the opening of a control valve for the great-hit catcher 9 if a predetermined combination of figures is achieved at the interruption. If this special condition is attained, the great hit causes the pachinko machine to open the great-hit catcher 9 thereby to establish a situation in which the player takes an advantage of catching more pachinko balls.

As shown in FIG. 1, the pachinko machine is generally identical without any substantial change in appearance to those used in the prior art.

Figure 4:
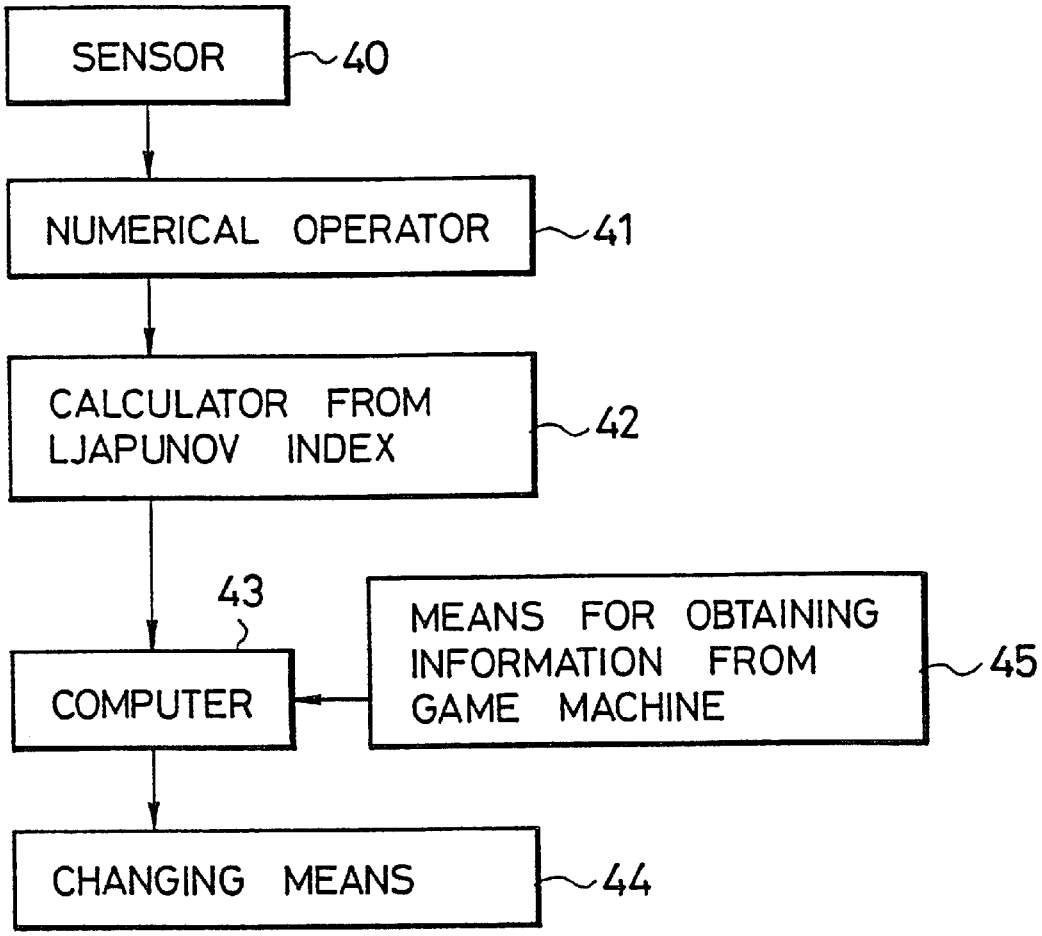
FIG. 4 is a block diagram in case the present invention is applied to the pachinko machine.

FIG. 4 is a flow chart for applying the concept of chaos of the present invention to the pachinko machine. The pulse wave data fetched from a sensor 40 for collecting the information of the player are converted into a chaos attractor by a numerical operator 41. The chaos attractor thus converted is then compared with a predetermined defining condition of the chaos, and an index calculated by a calculator 42 from the Ljapunov index indicating the degree of satisfying that condition is fed to a computer 43 for controlling the pachinko machine. The indication or information of this computer 43 is fed to changing means 44 for changing the content of the game. Thus, this game content is changed according to the situation of the player at that time.

The computer 43 may be fed with the data from the pachinko machine itself as other data. These data are enumerated by the reward data of balls to the rewarding catchers, the great-hit data of the game unit or the situation of the control valve of the great-hit catcher 9. The computer 43 enables the pachinko machine to cope with the various situations by processing those data and sending the commands or data for the various changes to the changing means 44.

In the present embodiment, the chaos attractor obtained from the pulse waves of the player is utilized to change the responses for meeting the pachinko machine. In order to get informed about the psychosomatic state of the player, according to the present embodiment, the ball shooting grip 1 is equipped with a pulse wave sensor for measuring the pulse waves at the fingertip of the player.

Figure 2:
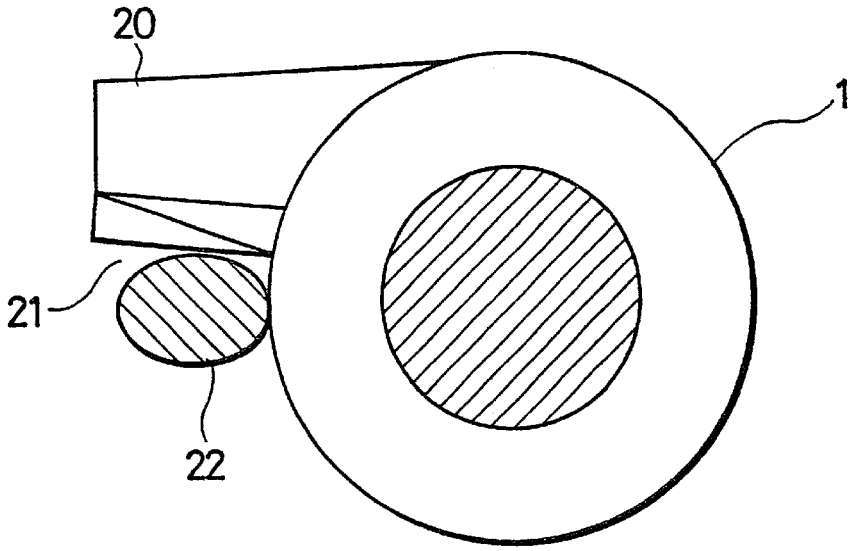
FIG. 2 is a schematic diagram showing a grip of the ball shooter of the pachinko machine of the present invention.

The ball shooting grip 1 is schematically shown in an enlarged scale in FIG. 2. This grip 1 can be turned to command the shot itself of the pachinko balls and the shooting intensity. The grip 1 is equipped at its outer circumference with a knob 20 having a function to aid the turning motion.

The pachinko balls are usually shot by turning the grip 1 to the right. For this shooting action, the player actuates the grip 1 by applying his fingertip 22 to the lower side 21 of the knob 20. Thus, the pulse wave sensor 25 is fitted in that portion of the knob 20, at which the fingertip 22 abuts against the lower side 21.

In the present embodiment, the pulse wave sensor is composed of an infrared-emitting diode and a photosensor so that the reflection of the infrared ray emitted from the diode may be sensed by the photosensor to acquire the information of the pulse waves of the player.

Figure 3:
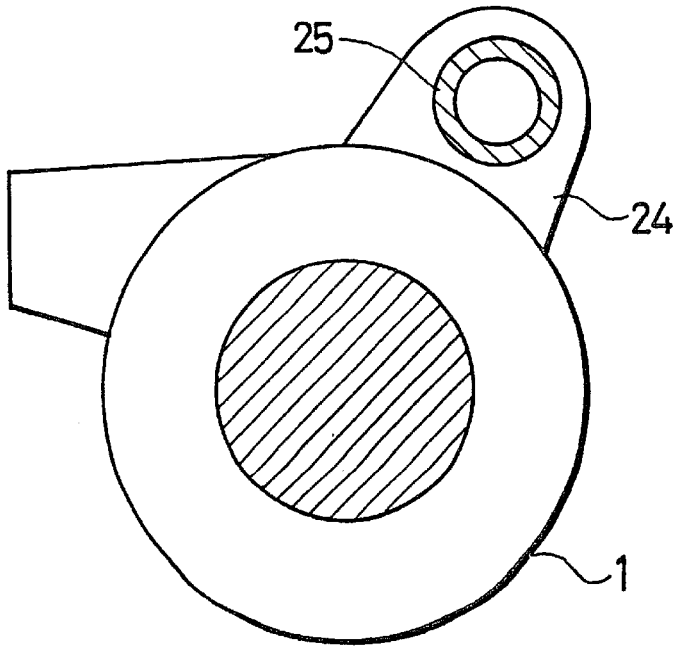
FIG. 3 is a schematic diagram showing a grip of the ball shooter of the pachinko machine of the present invention.

In an alternative mode of embodiment, the knob of the grip is formed with a finger hole 24, in which the pulse wave sensor 25 is fitted, as shown in FIG. 3. In this modification, the sensor can be held in complete contact with the fingertip so that the pulse waves of the player can be acquired more reliably.

In another structure, the pulse wave sensor can be disposed in at least such a portion of the ball shooting grip as is grasped by the player. Moreover, the sensor to be used should not be limited to that using the photo-coupler but can also utilize a pressure sensor.

The pulse wave information thus achieved from the player is converted into the chaos attractor by the arithmetic operation means so that it is recognized as the chaos attractor information indicating the present psychosomatic state of the player. Next, the chaos attractor recognized is compared with the chaos attractor which has already been classified and registered. Then, the Ljapunov number responding to a predetermined level is achieved by the arithmetic operating means so that the responses to be taken by the pachinko machine is changed according to that numerical value.

The changes in the responses of the pachinko game and its machine will be specifically described in the following. If the prevailing psychosomatic state of the player is in an "unexcited" situation so that this situation is recognized through the arithmetic operator by arithmetically processing the data obtained from the aforementioned sensor, the rewarding catcher 6, for example, other than the ordinary game unit starting chucker catcher 3 is set to a concurrent game unit starting chucker catcher. The game unit is also started when a pachinko ball lands in the reset rewarding catcher 6. The subsequent responses are identical to the ordinary ones so that the great hit is rewarded if the specific combination is obtained among the figures. Otherwise, a predetermined number of more balls are returned.

Thus, the psychosomatic state of the player obtained from the sensor mounted in the shooting grip is arithmetically processed to assign the game to the level under the predetermined condition, e.g., the "unexcited" level as in this case. Then, a command is issued to take a response different from that of the ordinary pachinko machine so that the gate unit can be unintentionally started to attract the interest of the player.

In the present embodiment, the unexpected game is started by the pachinko machine so that the game can be changed from that of the ordinary pachinko to make variations.

In the embodiment described above, the response of the pachinko game is changed in the game but should not be limited thereto. For example, the circumstances of the player such as the air conditioning, illuminations or music can also be changed to prevent the player from losing his or her interest.

Embodiment 2

The present embodiment is exemplified by applying the concept of chaos of the present invention to a rotary drum type game machine.

If the prevailing psychosomatic state of the player is in the "excited" situation, this situation is recognized through the machine or the numerical operator by arithmetically processing the data obtained from the aforementioned sensor. Then, the turning velocity of the rotary drum type game machine can be accelerated to make the player enthusiastic in the game so that he or she may be kept hot. Moreover, the content of the game can be changed by making the time period for the turning of the game machine to halt shorter than the ordinary one so that the player may see the game result earlier.

Embodiment 3

The present embodiment is exemplified by applying the concept of chaos of the present invention to the facilities of a game parlor equipped with a plurality of game machines. Specifically, the game parlor is usually arranged with a number of game machines in a block or matrix shape. These game machines are wholly or partially changed into those capable of grasping the prevailing psychosomatic states of the players. The data of these game machines are processed by another computer disposed in the game parlor to grasp the distribution of the games in specific psychosomatic situations.

If the distribution of the "unexcited" players is grasped, for example, the kind of music to be served to the parlor is changed to provide the circumstances for the players to get "excited" or "thrilled". This changing method can fit the prevailing situations of the players by changing the parlor entirely or partially according to the distribution of the players in a specific state.

In all the three embodiments described above, the concept of chaos is applied, but this application should not be limitative. Even if the application of the concept of chaos is impossible, the conditional level is determined in advance to classify the players so that the game machines can be given the change in the response like the case of applying the concept of chaos. In this modification, various responses can be achieved by changing the predetermined level and the kinds of information from the players.

According to the construction of the present invention, as has been described hereinbefore, it is possible to provide the contents and circumstances conforming to the prevailing psychosomatic situations of the players. Moreover, the contents, responses and circumstances of the games can be changed according to the situations of the players so that the players can continue their interests in the games for a long time without any loss.

The game contents are not limited to one pattern but can be changed according to the psychosomatic situations of the players or any of the levels predetermined by the players. Thus, it is possible to realize a novel game stressed on the players.

What is claimed is:

1. A game system comprising:

a plurality of game machines having a capability of detecting information from a plurality of players; and a computer having a capability of gathering the information from the plurality of game machines, assigning the information to a plurality of predetermined levels, and controlling a game level for each player in accordance with the assigned one of the predetermined levels.

2. A game system according to claims 1, wherein the information is a physical state of the player.

3. A game system according to claim 1, wherein each of the predetermined levels is defined by a chaos attracter.

4. A game system comprising:

a game machine having a capability of detecting information from a player, and a computer having a capability of assigning the information from the game machine to a plurality of predetermined levels, and controlling a game level for the player in accordance with the assigned one of the predetermined levels.

5. A game system according to claim 4, wherein the information is a physical state of the player.

6. A game system according to claim 4, wherein each of the predetermined levels is defined by a chaos attracter.

7. A game system comprising:

means for detecting information from a plurality of players;

means for assigning the information to a plurality of predetermined levels, and means for controlling a game level for each player in accordance with the assigned one of the predetermined levels.

8. A game system according to claim 7, wherein the information is a physical state of the player.

9. A game system according to claim 7, wherein each of the predetermined levels is defined by a chaos attracter.

10. A game system comprising:

a plurality of game machines having a capability of detecting information from a plurality of players, and a computer having a capability of gathering the information through the plurality of game machines, assigning the information to a plurality of predetermined levels, grasping the distribution of the players in specific predetermined levels, and controlling a game level for the plurality of players in accordance with the distribution of the players in the specific predetermined levels.

11. A game system according to claim 10, wherein the information is a physical state of the player.

12. A game system according to claim 10, wherein each of the predetermined levels is defined by a chaos attracter.

13. A game system comprising:

a plurality of game machines having a capability of detecting information from a plurality of players; and a computer having a capability of gathering the information from the plurality of game machines, assigning the information to a plurality of predetermined levels, and controlling a game level for each player in accordance with the assigned one of the predetermined levels, wherein said computer is remote from the plurality of game machines.

14. A game system according to claim 13, wherein the information is a physical state of the player.

15. A game system according to claim 13, wherein each of the predetermined levels is defined by a chaos attracter.

16. A game system comprising:

a game machine having a capability of detecting information from a player, and a computer having a capability of assigning the information from the game machine to a plurality of predetermined levels, and controlling a game level for the player in accordance with the assigned one of the predetermined levels, wherein said computer is remote from said machine.

17. A game system according to claim 16, wherein the information is a physical state of the player.

18. A game system according to claim 16, wherein each of the predetermined levels is defined by a chaos attracter.

19. A game system operating method comprising the steps of:

preparing the game system comprising a plurality of game machines and a computer;

detecting information from a player in each of the game machines;

gathering the information to the computer from the plurality of the game machines;

assigning the information to a plurality of predetermined levels, and controlling a game level for the player in accordance with the assigned one of the predetermined levels.

20. A game system operating method according to claim 19, wherein the information is a physical state of the player.

21. A game system operating method according to claim 19, wherein each of the predetermined levels is defined by a chaos attracter.

22. A game system operating method comprising the steps of:

preparing the game system comprising a game machine and a computer;

detecting information from a player in the game machine;

generating the information to the computer;

assigning the information to a plurality of predetermined levels, and controlling a game level for the player in accordance with the assigned one of the predetermined levels.

23. A game system operating method according to claim 22, wherein the information is a physical state of the player.

24. A game system operating method according to claim 22, wherein each of the predetermined levels is defined by a chaos attracter.

25. A game system operating method comprising the steps of:

preparing the game system comprising a plurality of game machines and a computer;

detecting information from a player in each of the game machines;

gathering the information from the plurality of the game machines to the computer;

assigning the information to a plurality of predetermined levels, and grasping the distribution of the players in specific predetermined levels, and controlling a game level for all players in the plurality of the game machines in accordance with the distribution of the players in the predetermined levels.

26. A game system operating method according to claim 25, wherein the information is a physical state of the player.

27. A game system operating method according to claim 25, wherein each of the predetermined levels is defined by a chaos attracter.

* * * * *